United States Patent [19]

Glassman

[11] Patent Number: 4,525,950

[45] Date of Patent: Jul. 2, 1985

[54] RECEPTACLE FOR ARTICLES OR THE LIKE

[76] Inventor: Donald Glassman, 4601 N. Federal Hwy., Pompano Beach, Fla. 33064

[21] Appl. No.: 581,967

[22] Filed: Feb. 21, 1984

[51] Int. Cl.[3] ..... A01G 5/00

[52] U.S. Cl. ..... 47/41 R; 47/41 SS; 47/66

[58] Field of Search ..... 47/41, 41.1, 41 R, 41 SS, 47/60, 61; D11/143, 149

[56] References Cited

U.S. PATENT DOCUMENTS

| | | | |
|---|---|---|---|
| 53,279 | 3/1866 | Dithridge | 47/41 |
| 1,213,940 | 1/1917 | Parker et al. | 47/41 |
| 1,627,649 | 5/1927 | Karabin et al. | 47/41 |
| 4,065,016 | 12/1977 | Perkins | 47/41 R |

FOREIGN PATENT DOCUMENTS

| | | | |
|---|---|---|---|
| 290320 | 6/1914 | Fed. Rep. of Germany | 47/41 |

*Primary Examiner*—Robert A. Hafer
*Assistant Examiner*—Bradley M. Lewis
*Attorney, Agent, or Firm*—Malin, Haley, McHale & Barron

[57] ABSTRACT

A receptacle usable as a flower vase, and especially adapted to present the illusion of being filled with a liquid to a level called the "illusion line." The vase has an inner tubular insert sealed to an outer receptacle at the common rim of the outer receptacle and tubular insert. The outer receptacle and tubular insert define between them a cavity or space which can be filled with a transparent fluid. In use, artificial flowers or any decorative material that one might wish to store dry can be placed within the inner tubular insert, and the liquid within the cavity will present the illusion of the receptacle being completely filled with liquid, and the decorative material being immersed in this liquid.

8 Claims, 3 Drawing Figures

RECEPTACLE FOR ARTICLES OR THE LIKE

BACKGROUND AND SUMMARY OF THE INVENTION

Transparent flower vases present the appearance of a bowl filled to a certain level with water surrounding the stems of flowers displayed in the vase. As any flower lover knows, this appearance is thought to be very attractive. Heretofore the use of artificial flowers in such vases was discouraged because many kinds of artificial flowers could not be submerged in water for any extended period of time. Similarly, because such transparent vases could be used only with natrual or otherwise waterproof flowers, the use of such transparent vases were, to an extent, discouraged.

It is accordingly an object of this invention to overcome this deficiency of the prior art, and provide a receptacle usable as a flower vase that can hold artificial flowers in a dry state, while maintaining the appearance of a water filled vase.

It is a further object of this invention to provide such a receptacle that is simple and rugged of construction, and simple and inexpensive of manufacture.

It is a further object of this invention to provide such a receptacle that is alternatively usable with real flowers.

In accordance with these and other objects that shall become apparent hereinafter, there is provided a receptacle system formed of two receptacle members, each receptacle member being generally ovate or tubular in shape, each having a central opening, and each sized so that one of the receptacle members can locate centrally within the other. The central opening of each of the receptacle members has a rim portion. The rim portions seat against each other so as to close off and define a hermetically sealed cavity disposed between the outer surface of one receptacle member and the inner surface of the other. Any appropriate liquid that has an equivalent refraction of light index as the inner receptacle member (for example alcohol, mineral oil or mineral spirits) may be placed up to a certain level within the cavity, called the "Illusion Line", so as to present the appearance of a vase completely filled with water. Artificial flowers, or for that matter any other decorative material, may then be placed within the inner receptacle member and, although kept in a dry state, will present the appearance of being submerged within a water filled vase.

The instant invention will be more fully understood in the following detailed description, it being understood, however, that the invention is capable of extended application, and is not confined to the precise disclosure. Changes and modifications may be made that do not affect the spirit of the invention as set forth in the appended claims, nor exceed the scope thereof. Accordingly, the instant invention will now be described with particular reference to the accompanying drawings.

BRIEF DESCRIPTION OF THE DRAWINGS

FIG. 3 is a photograph of an embodiment of the invention, illustrating the unique visual effect produced by the invention.

DETAILED DESCRIPTION OF A PREFERRED EMBODIMENT

Figure 1:
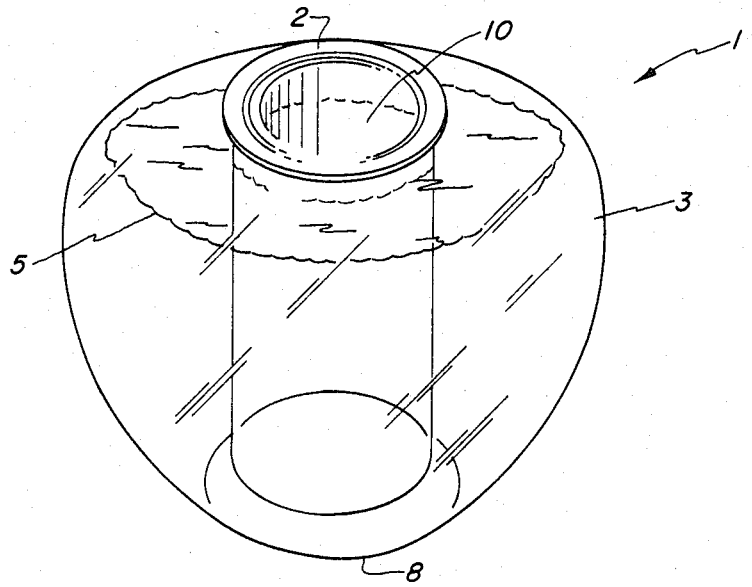
FIG. 1 shows an elevational, perspective view of the receptacle of the instant invention.
Figure 2:
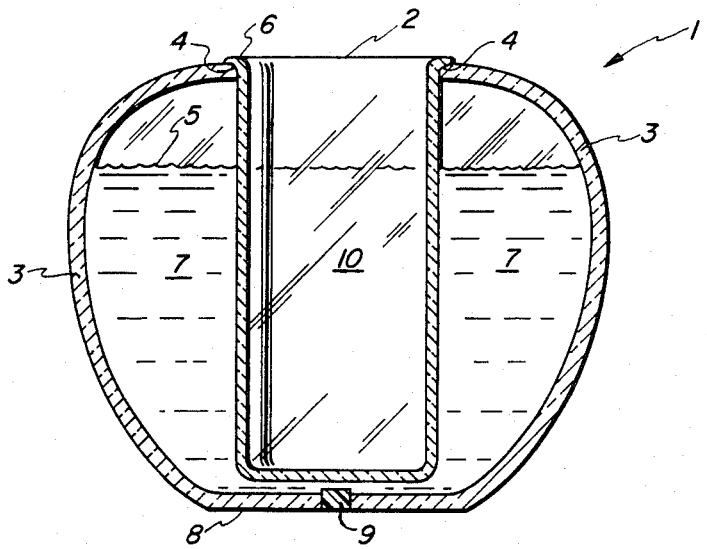
FIG. 2 shows a sectional view of the instant invention along the lines 2—2 of FIG. 1.

With particular reference to the drawing figures, the receptacle system of the instant invention is shown generally at 1. Receptacle system 1 has an outer, or first, receptacle member 3, and a second, or inner, receptacle member 2. Each receptacle member 2, 3 has a centrally located opening, about the periphery of which is located respective rims 4, 6. Each receptacle member 2, 3 is in the form of hollow surface closed at one end and open at the other, first receptacle member 3 being larger and more ovate, second receptacle member being more narrow and tubular, and each receptacle member 2, 3 having a centrally disposed opening with respective rims 4, 6, that enables second receptacle member 2 to pass through the opening of first receptacle member 3. Rims 4, 6 are sized and shaped so that the rims seat together to provide both mechanical support for receptacle member 2 as well as to form a hermetically sealed cavity 7. Rims 4 and 6 may be permanently attached by any appropriate means, for example by use of adhesives or welding techniques.

Best visual results are had if the refractive power of the liquid is significantly greater than that of the material of which the receptacle system is constructed. In a preferred embodiment, the liquid is mineral oil and the receptacles 2, 3 of clear plastic. Alternatively, the members 2, 3 can be made of colored, transparent plastic, glass, or the like. By using such tinted materials, less light can pass through receptacle system 1, and the same visual effect (i.e., the obscuring the outline of inner receptacle member 2) can be achieved with materials whose relative refractive power is correspondingly less. Outer receptacle member 3 has a flat base portion 8 which allows the receptacle system to stand upright on a flat surface. In flat base portion 8 is located a plug 9 which serves to hermetically seal a second opening through the receptacle member 3.

It should be noted that the liquid may be placed in the outer receptacle by methods other than through a fill hole in bottom 8. The liquid may be poured through the opening at 4 before the inner receptacle 2 is inserted and sealed in place.

In use, cavity 7 would be filled with a water-resembling liquid to desired liquid level 5, cavity 7 would be sealed by plug 9 (or, in an embodiment having no such plug 9, sealed by the permanent attachment together of rims 4, 6 the receptacle system would be placed in a conspicuous location, and into dry cavity 10 would be inserted any appropriate decorative material, such as artificial flowers, or, alternatively, cavity 10 could be filled with water and real flowers placed therein. Because the liquid in cavity 7 surrounds dry area 9, the receptacle system will appear to a casual observer to be a water filled vase, and will yield its true nature only upon very close inspection.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A receptacle system adaptable to present the illusion of being completely filled to a generally horizontal liquid level, said receptacle system comprising:

a first receptacle means, said first receptacle means being generally hollow and comprising an opening having a rim, said first receptacle means being of substantially transparent material;

a second receptacle means located within said first receptacle means, said second receptacle means being generally hollow, of generally tubular shape, and disposed within said opening of said first receptacle means, said second receptacle means comprising an opening having a rim, said rim of said second receptacle means being disposed to overlie said rim of said first receptacle means so as to be mechanically supported by said rim of said first receptacle means, said second receptacle means being of substantially transparent material;

said rim of said first and said second receptacle means each being sized and shaped so that said rims together form a seal; and a cavity means disposed between the inner surface of said first receptacle means and the outer surface of said second receptacle means, said cavity being hermetically sealed by said seal.

2. The system of claim 1, wherein a portion of said cavity contains a substantially transparent liquid, whereby the surface of said liquid presents said illusion of said receptacle system being completely filled to the level of said surface.

3. The system of claim 2, wherein said first receptacle means comprises a second opening, said second opening being hermetically sealed by a plug means.

4. The system of claim 3, wherein said plug constitutes a removable means for enabling fluid ingress and egress to said cavity through said second opening.

5. The system of claim 4, wherein said first receptacle means comprises a flat portion on at least a portion of at least the outer surface of said first receptacle means, said first receptacle means being effective as a base to support upright said receptacle system on a flat surface, said second opening being through said flat portion.

6. The system of claim 1, wherein said first receptacle means comprises a second opening, said second opening being hermetically sealed by a plug means.

7. The system of claim 6, wherein said plug constitutes a removable means for enabling fluid ingress and egress to said cavity through said second opening.

8. The system of claim 7, wherein said first receptacle means comprises a flat portion on at least a portion of at least the outer surface of said first receptacle means, said first receptacle means being effective as a base to support upright said receptacle system on a flat surface, said second opening being through said flat portion.

* * * * *